United States Patent [19]

Chapman

[11] Patent Number: 5,040,439

[45] Date of Patent: Aug. 20, 1991

[54] ADJUSTABLE WRENCH

[76] Inventor: William C. Chapman, 26451 Anchorage La., P.O. Box 402, Helendale, Calif. 92342

[21] Appl. No.: 320,886

[22] Filed: Mar. 9, 1989

Related U.S. Application Data

[63] Continuation-in-part of Ser. No. 95,853, Sep. 14, 1987, abandoned.

[51] Int. Cl.[5] ..... B25B 13/52

[52] U.S. Cl. ..... 81/65.2; 81/3.43

[58] Field of Search ..... 81/64, 65, 65.2, 68, 81/69, 70, 65.4, 3.43, 165, 170, 180.1, 185.1

[56] References Cited

U.S. PATENT DOCUMENTS

| | | | |
|---|---|---|---|
| 1,290,530 | 4/1988 | Evans | 81/65.2 |
| 1,587,892 | 6/1926 | Bessolo | 81/65.4 |
| 2,000,012 | 5/1935 | Cullen | 81/70 |
| 2,784,628 | 3/1957 | Meredith | 81/68 |
| 3,613,486 | 10/1971 | Chapman | 81/185.1 |

FOREIGN PATENT DOCUMENTS

| | | | |
|---|---|---|---|
| 0002832 | 12/1918 | Netherlands | 81/165 |
| 0461823 | 2/1937 | United Kingdom | 81/65.4 |

*Primary Examiner*—Frederick R. Schmidt
*Assistant Examiner*—Lawrence Cruz

[57] ABSTRACT

This application discloses an improvement for a conventional open-end adjustable wrench comprising a recess in the movable jaw of the wrench adapted to receive the first end of a chain. Spring biasing means on the first end of the chain to releasably retain the first end of the chain in the recess and a curved lip on the fixed jaw adapted to receive and retain the opposite second end of the chain are also disclosed. Finally, a ratchet-like motion achieved by the modified wrench is disclosed wherein the work object is engaged in a non-slip manner during the movement of the wrench handle in one direction, and in a slipping manner during the movement of the wrench handle in the opposite direction. The unique refined feature of maximum adjustment provided by the flexible movement of the wrench jaw being repositioned where the knurl is moved allows the full ratchet-like action motion to be applied to the work object.

24 Claims, 2 Drawing Sheets

ADJUSTABLE WRENCH

This is a continuation-in-part of co-pending application Ser. No. 07/095,853, filed on Sept. 14, 1987, now abandoned.

BACKGROUND OF THE INVENTION

1. Field of the Invention

This invention relates to hand tools and has particular reference to conventional open-end adjustable wrenches having a fixed jaw and a movable jaw.

2. Description of the Prior Art

The prior art is typically represented by Chapman U.S. Pat. No. 3,613,486, the Applicant herein, which discloses a device for making a conventional open-end adjustable wrench into an all purpose type of gripping wrench. The invention of this reference resides in the particular combination and arrangement of elements, and particularly, in a flat plate-like element having serrations at one end and a curved lip at the other end, which device is designed to be received in the slotted end of a conventional open-end wrench, so that the wrench may be converted into an all-purpose wrench to encircle and grip any regular or irregular shape, with the addition of a conventional sprocket chain.

Distinct from this reference, the present application discloses and claims an invention integral with the wrench structure and not, as in the reference, a separate element that is used in association with a wrench.

An apparatus constructed in accordance with the invention disclosed herein eliminates many of the deficiencies found in prior art devices as is better described below.

SUMMARY OF THE INVENTION

An object of the invention is to generally improve devices of the character indicated and to provide an improved wrench which is simple in construction, economical to manufacture, and efficient in operation.

Another object of the invention is to provide a device of the character indicated which may be used to transform a conventional open-end adjustable wrench, a ratchet wrench, or a socket wrench, into an all-purpose wrench.

Yet another object of the invention is to provide a device which, when applied to a conventional open-end adjustable wrench, may be used to loosen and remove the screw-on lid from a conventional glass jar without damaging the lid or the jar.

The ratchet-like motion has a unique refined feature of adjustment provided by the flexible movement of the wrench jaw being repositioned when the knurl is moved.

Still another object of the invention is to provide a device which, when applied to a conventional open-end adjustable wrench, may be used to loosen a wide variety of varying-sized items such as a nut, an oil filter, or a pipe.

A still further object of the invention is to provide a device which achieves a ratchet-like motion when the wrench handle is used to apply torque to the work object, i.e., the wrench engages the work object in a non-slip manner during the movement of the wrench handle in one direction, and in a slipping manner during the movement of the wrench handle in the opposite direction.

The prime purpose of the invention is to disclose an improved conventional open-end adjustable wrench having a fixed jaw and a movable jaw with a recess in the movable jaw adapted to receive therein a first end of a sprocket chain. Spring biasing means on the first end of the chain releasably retain the first end of the chain in the recess, and the opposite second end of the chain is received on a curved lip formed on the fixed jaw. The chain may be comprised of a leaf structure, or a roller structure, or a combination of sections having both leaf and roller construction. The fixed jaw may have serrations thereon.

This combined structure allows for a ratchet-like motion when the wrench handle is used to rotate the work object. The jaw, whether it has serrations or not, and the chain or strap of whatever structure, engage the work object in a non-slip manner during the movement of the wrench handle in one direction, and in a slipping manner during the movement of the wrench handle in the opposite direction.

The novel features of construction and operation of the invention will be more clearly apparent during the course of the following description, reference being had to the accompanying drawing wherein has been illustrated a preferred form of the device and wherein like characters of reference are employed to denote like parts throughout the drawing.

DETAILED DESCRIPTION OF THE PREFERRED EMBODIMENTS

Figure 2:
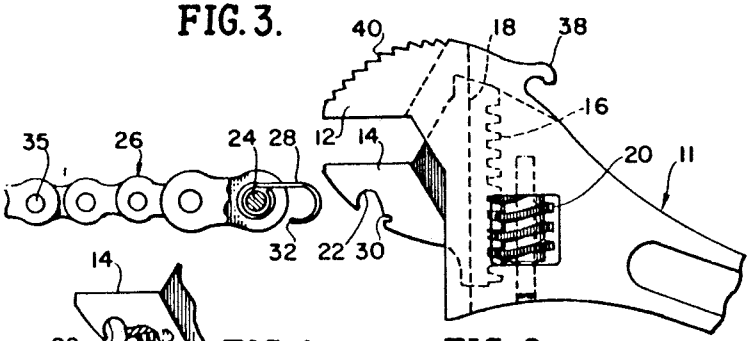
FIG. 2 is a partial side elevational view showing the chain member separated from the body of the wrench member.

Referring to the drawing, wherein like numbers of reference indicate like elements throughout, there has been illustrated by reference character 11, in general, a conventional open-end adjustable wrench having a fixed jaw 12 and a movable jaw 14. Movable jaw 14 has a rack-like extension 16 which reciprocates in a slot 18 formed in fixed jaw 12 (FIG. 2). A rotatable knurled screw 20 is arranged to engage the teeth of rack 16 to move jaw 14 in slot 18. The elements just described are the elements of a conventional open-end adjustable wrench and constitute no part of the invention, except as they are combined with the elements hereinafter described.

The invention consists of a curved recess 22 formed in jaw 14 and adapted to receive the cross pivot portion 24 of a chain 26. Spring biasing means 28 is attached to chain 26 and is shaped to have its lower portion 32 received in a channel 30 formed in the wall of recess 22. In practice, lower portion 32 of spring biasing means 28 is positioned into channel 30, the spring compressed to insert cross pivot 24 into recess 22. The tensional forces produced by spring biasing means 28 then retain cross pivot 24 abutting the walls of recess 22 and prevent its accidental release therefrom.

Figure 4:
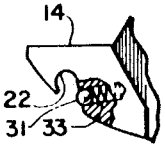
FIG. 4 is a partial view of the movable jaw showing an alternate method of retaining the end of the chain member.

In another preferred embodiment as shown in FIG. 4, the cross pivot pin 24 is retained in the curved recess 22 of the jaw 14 by means of a spring loaded steel ball 31 housed in the hole 33. The peripheral edges of the hole are peened to prevent the ball from being forced out.

Figure 6:
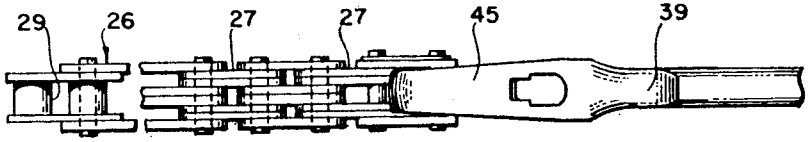
FIG. 6 is a partial top view of the wrench shown in FIG. 5.

Chain 26 is a conventional sprocket chain and may be comprised of a leaf chain 27 or a roller chain 29 construction as shown in FIG. 6. The ratchet-like motion action allows the ultimate adjustment to secure the work object and/or rotate the work object with the refined feature of adjustment provided by the flexible movement of the wrench jaw being repositioned when the knurl is moved. A preferred embodiment may comprise a sprocket chain having both a leaf and a roller chain section, so situated that the stronger leaf chain construction would be placed near the fulcrum point of the wrench when it engages an object to be either loosened or tightened.

Figure 1:
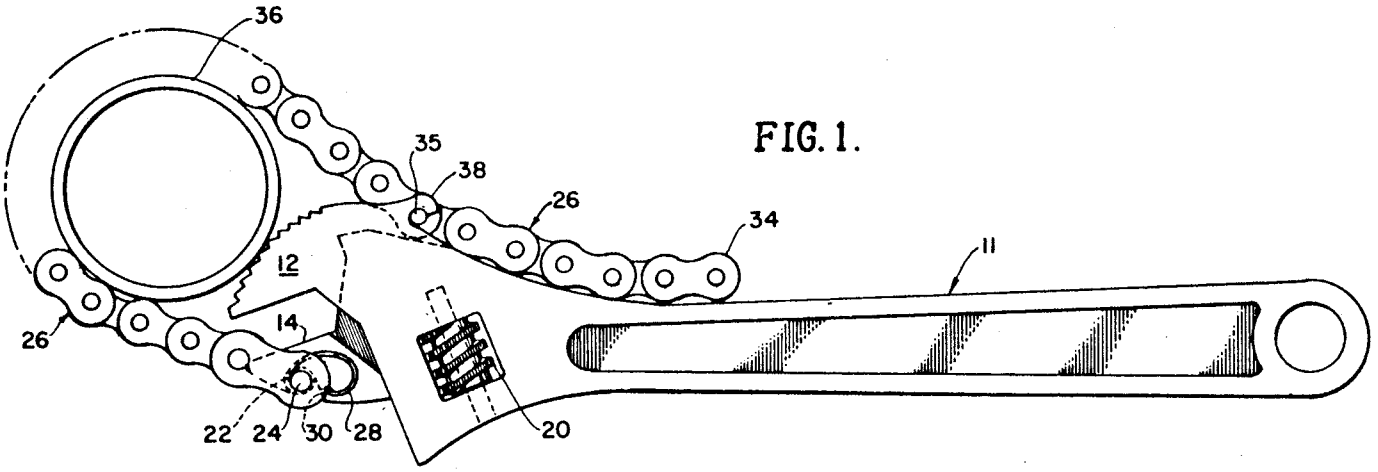
FIG. 1 is a side elevational view of an apparatus constructed in accordance with the invention.

Referring now to FIG. 1, free end 34 of chain 26 is extended around the object, here illustrated as a pipe in FIG. 1, and the connecting pin 35 of the chain linkage is inserted into the bifurcated hook 38 formed on jaw 12.

Once pipe 36 is encircled by chain 26, and chain 26 fastened to bifurcated hook 38, knurled screw 20 is adjusted to move rack 16 and jaw 14 in a direction to cause serrations or teeth 40 to contact the periphery of pipe 36. The conventional open-end adustable wrench 11, then becomes a wrench capable of being used as a pipe wrench or an all purpose wrench used on irregular shaped objects.

By varying the attachment point of chain 26 held by hook 38, the device may be easily adjusted to loosen or tighten various sized items ranging, for example, from a small nut to a large diameter pipe up to 72 inches if the length of chain 26 is sufficient to encircle the object.

Figure 5:
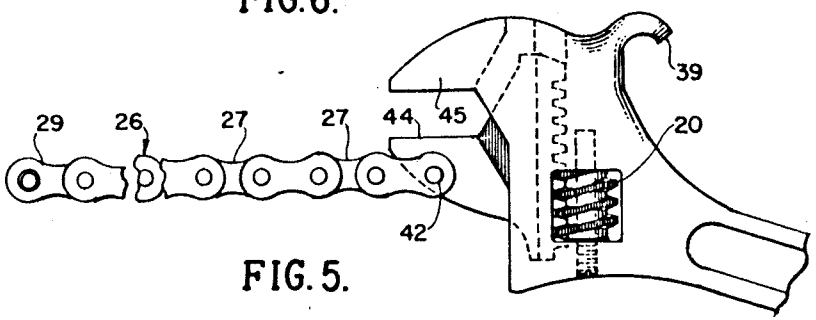
FIG. 5 is a partial side elevational view showing an alternate embodiment of the invention.
Figure 3:
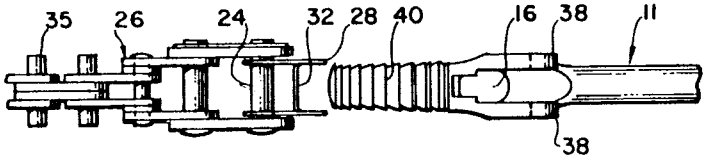
FIG. 3 is a partial top plan view of the wrench shown in FIG. 2.

Other preferred embodiments would have chain 26 pivoted, as at 42 in FIG. 5, to jaw 44. In this embodiment, chain 26 is permanently affixed to jaw 44 and cannot be separated therefrom, as can be the embodiment described above having a recess 22 and a spring biasing means 28. A singular hook 39 on the fixed jaw 45 enables the roller chain 29 to be attached thereon.

Figure 7:
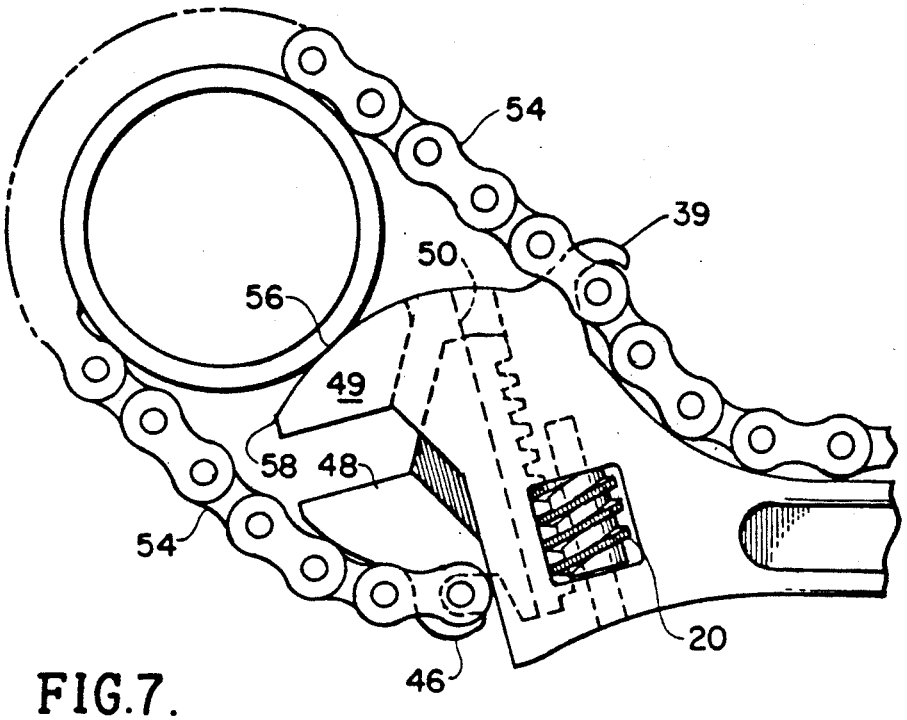
FIG. 7 is a partial side elevational view showing another alternate embodiment of the invention being used in association with a pipe.
Figure 8:
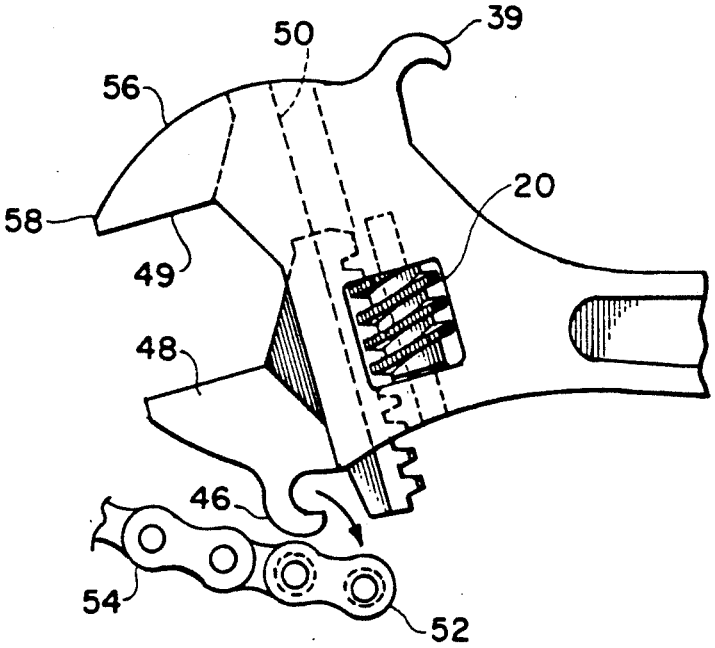
FIG. 8 is a partial side elevational view showing the chain member disengaged from the head of the wrench member as shown in FIG. 7.

Still another preferred embodiment of the invention would be found in a device as illustrated in FIG. 7 and FIG. 8. There, a singular hook 46 is formed in the jaw 48 in a position where jaw 48 must be retracted in slot 50 to expose the hook 46. Once the recess of hook 46 is exposed, as in FIG. 8, end 52 of chain 54 may be inserted into recess 46 and jaw 48 moved in an upward direction in slot 50 to prevent end 52 from being withdrawn from the recess in hook 46 as is seen in FIG. 7. The location of the hooks 39 on the head of the fixed jaw 49 and the hook 46 on the movable jaw 48 enables the wrench to bite the object encircled at contact point 56 or at the lip 58 of the fixed jaw 49. Twisting the knurled screw 20 in either direction will either tighten or loosen the sprocket chain 54 encircling the object.

Other preferred embodiments may comprise the structure and elements disclosed above by substituting a strap member of plastic or other material for the chain member. The means to retain the strap member to the movable jaw member can be the same means disclosed above, and the means to fasten the free end of the strap member to the hook member may be a plurality of holes in the free end of the strap member adapted to receive and retain the hook therein, as on fixed jaws shown in FIGS. 1, 2, 5, 7 and 8.

Referring again to FIG. 1, which shows the wrench 11 with chain 26 engaged around a work object, in this case a pipe 36, the movement of the wrench 11 and associated chain 26 in a ratchet-like fashion will now be described. In FIG. 1 it will be arbitrarily determined that the work object 36 is to be rotated in a closkwise fashion. This means that the handle of wrench 11 will be forced downward as the drawings are viewed when FIGS. 1 and 6 are displayed in a vertical relationship, i.e., FIG. 1 is at the top of the page. To rotate the work object 36 in a clockwise manner, torque will be applied to the handle of wrench 11 in a downward, clockwise direction. When force is applied in a downward, clockwise direction, the serrations on fixed jaw 12 engage the surface of the work object 36 with the force of the leverage provided by structure of the wrench 11. This provides for a non-slip engagement of the wrench 11 and associated chain 26 with the work object 36. The handle of wrench 11 can be rotated in a clockwise manner until surrounding structure limits its travel. In any case, the most common practical limitation upon rotation due to human ergonomics, would be for the handle of wrench 11 to be rotated through 90°, i.e., the wrench 11 being displayed in FIG. 1 as being in a horizontal position would end up in a vertical position with the handle pointing downward. To continue the rotation of the work object 36 further in a clockwise direction, the wrench 11 and associated chain 26 must then be rotated in a counter-clockwise manner. To do this, the handle of wrench 11 would be moved from its now vertical position back to its horizontal position as shown in FIG. 1, with the handle of wrench 11 biased in an upward, counter-clockwise direction. When the handle of wrench 11 is moved in such a manner, it should be noted that the serrations on fixed jaw 12 no longer engage in a non-slip manner the surface of the work object 36. In fact, due to the direction of movement of the handle of wrench 11, the work object 36 has no force applied to it because the surface of fixed jaw 12 and the surface of chain 26 where it is next to the surface of the work object 36 now no longer engage the surface of the work object 36 in any manner most of the time during movement. This non-slip manner of engagement allows the wrench 11 to be returned to the position of original engagement without completely disengaging the chain 26 from the work object. Because the motion is ratchet-like, great convenience is afforded to the person using wrench 11 with associated chain 26, in that it is no longer necessary to disengage and reengage the chain around the work object every time due to the travel of the handle of wrench 11 bein glimited by the surrounding mechanical or other structure or due to the ergonomic limits of effective application of force on the handle of wrench 11.

It should also be noted that the work object 36 is completely surrounded by the association of chain 26 with wrench 11. In other words, if the user should have to termporarily take his hand away from wrench 11, the complete encirclement of the work object 36 is such that the wrench 11 and chain 26 will remain proximate to the work object 36. This means that the user may manipulate other tools and then return to wrench 11 and continue the rotation of the work object 36 by application of force to the handle of wrench 11. When used by workers in special circumstances, such as on elevated structures (i.e. the worker is on a scaffold or otherwise high above the ground), this ability of wrench 11 and chain 26 to be reengaged in turning the work object 36 as soon as the user can once again grasp the handle of wrench 11, provides great convenience. It also eliminates the need for certain workers to carefully reengage the wrench 11 to the surface of the work object 36.

The invention described above is, of course, susceptible of many variations, modifications and changes, all of which are within the skill of the art. It should be understood that all such variations, modifications and changes are within the spirit and scope of the invention and the appended claims. Similarly, it will be understood that it is intended to cover all changes, modifications and variations of the example of the invention herein disclosed for the purpose of illustration which do not constitute departures from the spirit and scope of the invention.

I claim:

1. In a conventional open-end adjustable wrench having a fixed jaw and a movable jaw, the improvement comprising:

a recess in said movable jaw adapted to receive therein a first end of a chain;

a rotatable knurl for effecting movement of said movable jaw;

spring biasing means on said first end of said chain to releasably retain said first end of said chain in said recess; and a curved lip on said fixed jaw receiving a middle part or the second end of said chain, said chain and fixed and movable jaws forming a complete enclosure around a work object, said fixed jaw engaging said work object in a non-slip manner during the movement of the wrench handle in one direction, and in a slipping manner during movement of the wrench handle in the opposite direction so as to move said work object with ratchet motion wherein rotation of said knurl and resultant movement of said movable jaw finely adjust area of said complete enclosure around said work object for controlling said ratchet motion.

2. The apparatus in accordance with claim 1 wherein said chain is a leaf chain.

3. The apparatus in accordance with claim 1 wherein said chain is a roller chain.

4. The apparatus in accordance with claim 1 wherein said chain has a leaf chain section and a roller chain section of predetermined length, said predetermined being slightly lesser than the object encompassed.

5. The apparatus in accordance with claim 4 wherein leaf chain section of said chain is adjacent said first end of said chain of predetermined length, said predetermined being slightly lesser than the object encompassed.

6. The apparatus in accordance with claim 1 wherein said fixed jaw has serrations thereon and said serrations serve as the point of engagement between said fixed jaw and said work object.

7. The apparatus in accordance with claim 1 wherein said curved lip on said fixed jaw is bifurcated.

8. In a conventional open-end adjustable wrench, having a fixed jaw and a movable jaw, the improvement comprising:

a rotatable knurl for effecrting movement of said movable jaw;

first retaining means in said movable jaw;

second retaining means on said fixed jaw; and a chain secured at one end in said first retaining means and having a middle part or opposite end of said chain releasable received in said second retaining means such that said chain and fixed and movable jaws form a complete enclosure around a work object, said fixed jaw engaging said work object in a non-slip manner during the movement of the wrench handle in one direction, and in a slipping manner during movement of the wrench handle in the opposite direction so as to move said work object with ratchet motion wherein rotation of said knurl and resultant movement of said movable jaw finely adjust area of said complete enclosure around said work object for controlling said ratchet motion.

9. The apparatus in accordance with claim 8 wherein said first retaining means comprises a recess in said movable jaw adapted to receive therein said one end of said chain.

10. The apparatus in accordance with claim 8 wherein said first retaining means further includes spring biasing means on said first end of said chain to releasably retain said first end of said chain in said recess.

11. The apparatus in accordance with claim 8 wherein said second retaining means comprises a curved lip on said fixed jaw adapted to receive said opposite second end of said chain thereon.

12. The apparatus in accordance with claim 11 wherein said curved lip on said fixed jaw is bifurcated.

13. The apparatus in accordance with claim 8 wherein said chain is a leaf chain.

14. The apparatus in accordance with claim 8 wherein said chain is a roller chain.

15. The apparatus in accordance with claim 8 wherein said chain has a leaf section and a roller chain section.

16. The apparatus in accordance with claim 8 wherein said fixed jaw has serrations thereon and said serrations serve as the point of engagement between said fixed jaw and said work object.

17. The apparatus in accordance with claim 8 wherein said first retaining means comprises pivot means adapted to have said chain secured at one end to said pivot means.

18. The apparatus in accordance with claim 17 wherein said second means comprises a curved lip on said fixed jaw adapted to receive and retain said opposite second end of said chain.

19. The apparatus in accordance with claim 17 wherein said chain is a leaf chain.

20. The apparatus in accordance with claim 17 wherein said chain is a roller chain.

21. The apparatus in accordance with claim 17 wherein said chain has a leaf section and a roller chain section.

22. The apparatus in accordance with claim 17 wherein said fixed jaw has serrations thereon.

23. In a conventional open-end adjustable wrench, having a fixed jaw having a jaw neck and a moveable jaw the improvement comprising a knurl disposed in said wrench:

first retaining means at said moveable jaw, said first retaining means comprising a curved lip to retain chain within said jaw neck and when said moveable jaw is closed slightly by rotation of said knurl and released by opposite rotation of said knurl;

a second retaining means at disposed fixed jaw, said second retaining means comprising a curved lip to retain said chain; and said chain secured at one end in said first retaining means and having its opposite end releasably received in said second retaining means.

24. The apparatus in accordance with claim 8 wherein said moveable jaw is adapted to receive therein a first end of a chain said moveable jaw lip having a smooth surface to serve as the point of engagement between said moveable jaw and said work object; and the opposite second end of said chain received on a curved lip on said fixed jaw, said fixed jaw having serrations thereon to serve as the point of engagement between said fixed jaw and said work object.

* * * * *